United States Patent [19]

Giordano

[11] Patent Number: 4,927,049

[45] Date of Patent: May 22, 1990

[54] LOCKING RADIATOR CAP

[76] Inventor: John Giordano, 123 Hempstead, Lynbrook, N.Y. 11563

[21] Appl. No.: 393,997

[22] Filed: Aug. 15, 1989

[51] Int. Cl.[5] ..... B65D 55/00

[52] U.S. Cl. ..... 220/201; 220/DIG. 17; 220/DIG. 32

[58] Field of Search ..... 220/201, DIG. 17, DIG. 32; 292/DIG. 66

[56] References Cited

U.S. PATENT DOCUMENTS

| | | | |
|---|---|---|---|
| 2,125,419 | 8/1938 | Birk | 220/201 X |
| 2,250,045 | 7/1941 | Focke et al. | 220/DIG. 17 |
| 2,528,372 | 10/1950 | Kellogg | 220/201 |
| 3,373,894 | 3/1968 | Johnson | 220/301 |
| 3,559,839 | 2/1971 | Seethaler | 220/201 |
| 4,718,705 | 1/1988 | Case | 292/DIG. 66 X |

*Primary Examiner*—Stephen Marcus
*Assistant Examiner*—Nova Stucker
*Attorney, Agent, or Firm*—Collard, Roe & Galgano

[57] ABSTRACT

A thermally locking radiator cap for fitting on the filler neck flange of an automotive radiator, which prevents the radiator cap from becoming detached from the filler neck flange when the radiator is hot. The cap uses a bi-metallic strip captured on the top surface of the radiator cap and having an end which goes through the opening of the radiator cap and engages the filler neck flange to lock the cap in place. Colors are placed on the bi-metallic strip adjacent to a window at the top of the radiator cap so that when the bi-metallic strip moves as a result of expansion, the colors change to indicate that the cap is either locked or free.

6 Claims, 1 Drawing Sheet

LOCKING RADIATOR CAP

The present invention relates to a locking radiator cap that protects motorists and service station attendants against injury when engine is hot.

More specifically, the present invention provides a thermostatic controlled lock which prevents the removal of an automobile radiator cap until the radiator has cooled down.

BRIEF DESCRIPTION OF THE PRIOR ART

In conventional cooling systems, automobiles are operated at superatmospheric pressures so that the coolant is maintained at a temperature above its atmospheric boiling point. Moreover, coolant chemicals are used which do not begin to boil until well above the boiling point of water when maintained under pressure. Thus it is common for the fluid in automobile radiators, during hot summer days, to reach temperatures of 220° to 230° F. under pressure, without boiling over.

Most radiator caps are designed to be pushed down, and rotated about ½ a turn before locking to the filler neck of the radiator. Many radiator caps provide an intermediate dwell position in their bayonet-type securing means so that the cap will not detach itself from the radiator filler cap without first allowing the coolant to boil out under pressure. However in many instances the motorist or service station attendant twists the radiator cap beyond the intermediate dwell position so that the cap comes off and hot coolant liquid spews from the filler-neck to drench and scald the attending persons.

To overcome this problem, many prior art patents provide a pressure relief valve at the top of the cap so that the user can release the pressure through a small opening before opening the cap. One type of device is shown in the U.S. Pat. No. 3,373,894 to Johnson.

In the U.S. Pat. No. 2,528,372, to Kellogg, a thermal locking radiator cap is provided which has a bi-metallic strip, which when heated, causes an overcap to freely rotate on the radiator cap thus preventing its removal from the radiator. However, when the bi-metallic strip cools, the overcap engages the radiator cap with projections to permit removal of the radiator cap. The U.S. Pat. No. 3,559,839 to Seethaler relates to a safety lock for the handle of a pressure cooker. When the temperature of the pressure-cooking vessel reaches a certain point, a projecting arm raises from the handle into the cover of the pressure cooker, preventing the cover from being removed until the temperature of the pressure cooker cools.

Each of the prior art devices which prevent the removal of a cap or cover for a pressurized chamber have a disadvantage in that they are complex, do not necessarily protect the user from being sprayed with hot liquid and are mechanically unreliable.

BRIEF DESCRIPTION OF THE INVENTION

Accordingly, the present invention provides a thermally controlled radiator cap which is designed to fit into the filler neck of a standard automobile radiator, and uses a temperature-sensitive bi-metallic strip which extends downward into the filler neck to prevent the rotation and removal of the radiator cap when the temperature is too hot for the safe venting of the radiator. Moreover, the bi-metallic strip is provided with a color-code, such as red and green, which appears through a window at the top of the radiator cap. Thus, when the bi-metallic strip expands and prevents the cap from being unlocked, the color appearing through the window on the bi-metallic strip will change from green to red, indicating that the radiator has not cooled sufficiently to allow safe removal of the radiator cap, and that the bi-metallic lock has engaged the flange of the filler neck.

It is therefore an object according to the present invention to provide an improved radiator cap capable of thermally locking itself to the filler neck flange of a standard radiator when the contents of the radiator are at boiling temperature.

It is another object according to the present invention to provide a thermally locking radiator cap which is simple in design, easy to manufacture and reliable in use.

Other objects and features of the present invention will become apparent from the following detailed description considered in connection with the accompanying drawing which discloses the embodiment of the invention. It is to be understood however, that the drawing is designed for the purposes of illustration only, and not as a definition of the limits of the invention.

In the drawing, wherein similar reference characters denote similar elements throughout the several views:

A BRIEF DESCRIPTION OF THE DRAWINGS

Figure 1:
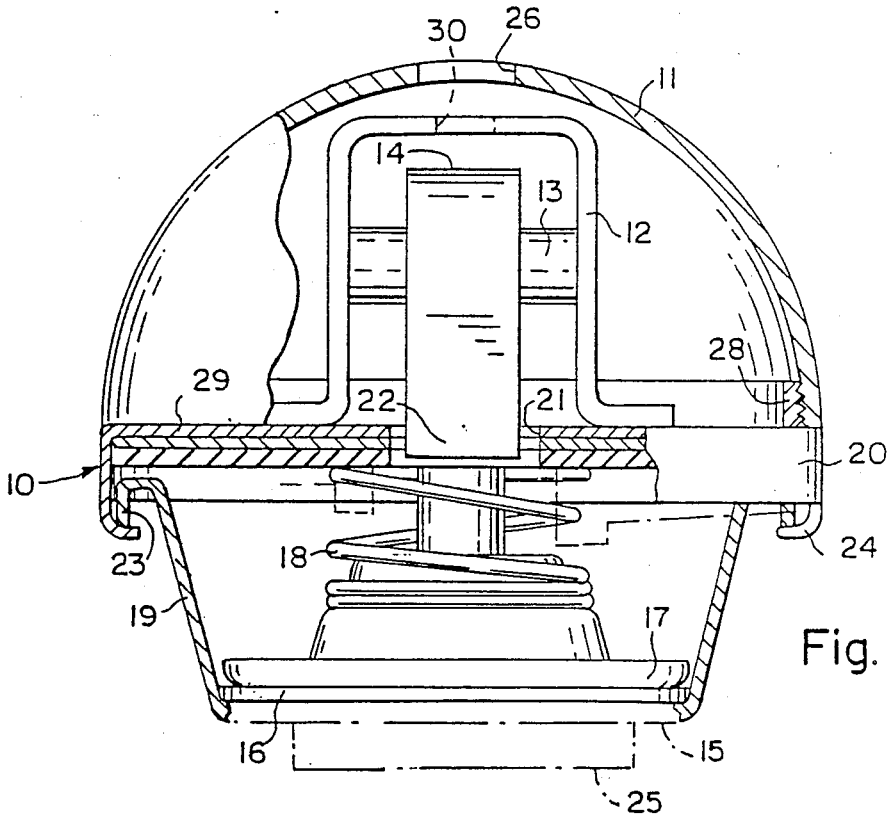
FIG. 1 is a side view, partly in cross-section, of the thermally locking radiator cap connected to the filler neck flange of an automobile radiator.

Referring to FIGS. 1–6 there is shown the radiator cap of the invention, generally designated as 10, having a flange-like cover portion 20, which fits over the radiator filler neck. The filler neck typically includes an internal seat 15 surrounding the filler mouth 25, which is peripherally surrounded by a flanged cup 19 having a downturned skirt 23. Skirt 23 is formed with diametrically opposite radially-opening notches 23 which engage the radial fingers 24 of the radiator cap. Cap fingers 24 are designed to enter through the notches 35 of the filler cap, as is well known in the prior art. Thus when the fingers enter through the filler neck notches, and the cap is turned in a clockwise direction as viewed from above, fingers 24 of the cap will ride downwardly over inclines formed in the filler neck before they pass the declivities where eventually they are arrested by stops which securely hold the cap. (See U.S. Pat. No. 3,373,894) At this point, spring 18 has been compressed, urging diaphragm 16 mounted on flange surface 17, against the internal seat 15 of the filler neck, thus forming a pressure seal over the contents of the radiator as is well known in the art.

Figure 2:
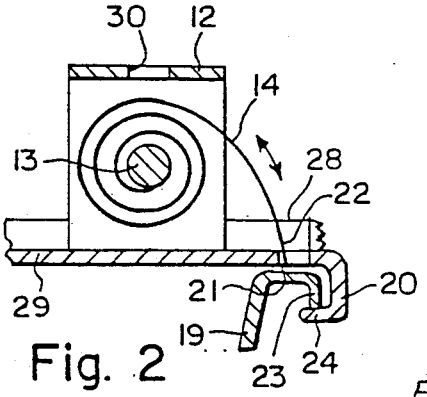
FIG. 2 is a side view, partly in cross-section, of the bi-metallic strip mounted on the top surface of the radiator cap.
Figure 4:
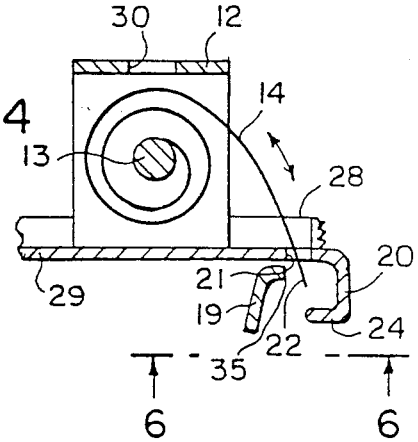
FIG. 4 is a view similar to FIG. 2 except showing the bi-metallic strip in a heated condition.
Figure 3:
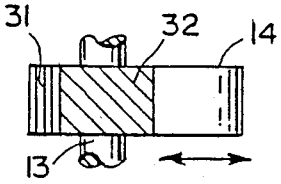
FIG. 3 is a top view of the bi-metallic strip showing its red and green indicating areas.
Figure 6:
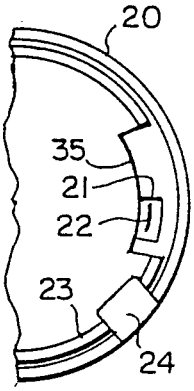
FIG. 6 is a cross-sectional view taken along line 6—6 of FIG. 4.
Figure 5:
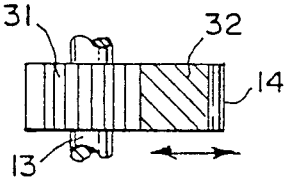
FIG. 5 shows the shifting of the green and red zones of the bi-metallic strip of FIG. 4 when the radiator cap is heated.

On radiator cap 10 there is provided a U-shaped bracket 12 on its top surface. An axial or trunnion 13 is secured to bridge the bracket in order to hold a bi-metallic strip 14 in place, as shown in FIGS. 2 and 4. A cover 11 is provided, having an opening 26 which looks down through the top opening 30 of U-shape bracket 12. Cover 11 is shown threaded to the top surface 29 of the cap by means of a peripheral threaded flange 28. Any other type of fastening means could also be used for cover 11. One end of temperature sensitive bi-metallic strip 14 is secured to trunnion 13, and the other end 22 is allowed to pass through an opening 21 in the top surface 29 of the cap 10.

When the automotive radiator is cool, bi-metallic strip 14 is shown coiled up as in FIG. 2 and a green indicator 32, which is painted on the top of top-leaf of the bimetallic strip shows through opening 30 and window 26 of cap cover 11, indicating that the radiator is cold.

When the radiator heats up to near the boiling temperature of the radiator fluid the bi-metallic strip 14 expands as shown in FIG. 4. Its leaf end 22 then passes through opening 21 of cap surface 29 and slot 35 of the filler neck as shown also in FIG. 6, and into notch 35, thus preventing the turning of the radiator cap with respect to the filler neck. This locks the radiator cap from any rotation or removal. The expansional movement of bi-metallic strip 14 also causes green area 32 to shift out of view of opening 30 and window 26, and causes the red-painted area 31, adjacent to the green, to shift under the window indicating to the user that the cap is in its locked position.

Once cap 10 is locked and end 22 of bi-metallic strip 14 engages into slot 35 of the filler neck flange, the cap cannot be removed until end 22 of bi-metallic strip 14 draws back through opening 21. This will only occur when the cap cools down as shown in FIG. 2.

In the design of cap 10, U-shaped bracket 12 and trunnion 13 are preferably metal so as to conduct the heat from the radiator to strip 14. Cover 11, which is optional, serves to retain the heat around strip 14. Bi-metallic strip 14 is constructed of two dissimilar metals commonly used in thermostats. While the top leaf of strip 14 is painted red and green, other colors may also be used.

While only a single embodiment of the present invention has been shown and described, many changes and modifications may be made thereunto without departing from the spirit and scope of the invention.

What is claimed is:

1. A thermally locking radiator cap for coupling to the filler neck flange of a conventional radiator wherein the filler neck flange is formed with diametrically opposite, radially-open opening notches for receiving the inwardly bent radial fingers of a radiator cap comprising;

thermally responsive stop means disposed on a surface of the radiator cap and in thermal communication with the cap, said stop means having one end secured to said cap and its opposite end disposed along the peripheral edge of the cap;

an opening formed along the outer periphery of said radiator cap for receiving said thermally responsive stop means so that when radiator heats up, said stop means will expand and pass through the opening formed in the periphery of the radiator cap and pass into a corresponding opening notch of the filler neck flange thereby preventing any rotational movement of the cap with respect to the filler neck;

2. The radiator cap as recited in claim 1 wherein said thermally responsive stop means comprises a bi-metallic strip.

3. The radiator cap as recited in claim 2 additionally comprising a U-shaped member mounted on said surface of the radiator cap and enclosing said bi-metallic; and, a trunnion coupled across the U-shaped member and securing one end of the bi-metallic strip to the cap so that the free end of said strip is in communication with the peripheral opening in said cap.

4. The thermally locking radiator cap as recited in claim 3 additionally comprising a window formed in the top surface of U-shaped member and;

indication means formed on said bi-metallic strip adjacent to said window so that when the bi-metallic shifts under the influence of heat, said indication means changes to indicate the locking or opening position of the radiator cap;

5. The thermally locking radiator cap as recited in claim 4 additionally comprising a concave cover secured to said surface of the radiator cap and enclosing said U-shaped member; and;

an opening formed at the top of said concave cover in communication of the opening of said U-shaped member to permit the viewing of the indication means on the top of said bi-metallic strip.

6. The thermally locking radiator cap and recited in claim 5 wherein said indication means comprises a red strip, and a green strip painted on said strip adjacent to said window.

* * * * *